US010480446B2

(12) United States Patent
Engelhardt

(10) Patent No.: US 10,480,446 B2
(45) Date of Patent: Nov. 19, 2019

(54) METHOD AND APPARATUS FOR COOLING A HEAT-GENERATING MODULE

(71) Applicant: GE Aviation Systems LLC, Grand Rapids, MI (US)

(72) Inventor: Michel Engelhardt, Woodbury, NY (US)

(73) Assignee: GE Aviation Systems LLC, Grand Rapids, MI (US)

( * ) Notice: Subject to any disclaimer, the term of this patent is extended or adjusted under 35 U.S.C. 154(b) by 78 days.

(21) Appl. No.: 15/742,633

(22) PCT Filed: Jul. 16, 2015

(86) PCT No.: PCT/US2015/040683

§ 371 (c)(1),
(2) Date: Jan. 8, 2018

(87) PCT Pub. No.: WO2017/011012

PCT Pub. Date: Jan. 19, 2017

(65) Prior Publication Data

US 2018/0202382 A1 Jul. 19, 2018

(51) Int. Cl.

| | |
|---|---|
| ***F01P 3/00*** | (2006.01) |
| ***F02D 41/30*** | (2006.01) |
| ***F01P 3/20*** | (2006.01) |

(52) U.S. Cl.

CPC ..... *F02D 41/3082* (2013.01); *F01P 3/00* (2013.01); *F01P 3/20* (2013.01); *F01P 2003/005* (2013.01); *F01P 2025/30* (2013.01); *F01P 2050/22* (2013.01); *F01P 2050/30* (2013.01); *F02D 2200/0606* (2013.01)

(58) Field of Classification Search

CPC ..... F02D 41/3082; F02D 2200/0606; F01P 3/20; F01P 3/00; F01P 2050/22; F01P 2050/30; F01P 2025/30; F01P 2003/005

See application file for complete search history.

(56) References Cited

U.S. PATENT DOCUMENTS 2,303,051 A * 11/1942 Jones ..... F01P 9/00 123/41.72
4,445,486 A * 5/1984 Rao ..... F01P 9/04 123/41.42

(Continued)

FOREIGN PATENT DOCUMENTS

DE 19900132 A1 7/2000
EP 0968885 A2 1/2005

(Continued)

OTHER PUBLICATIONS

International Search Report corresponding to PCT/US2015/040683 dated Nov. 27, 2015.

*Primary Examiner* — Hieu T Vo
*Assistant Examiner* — Sherman D Manley
(74) *Attorney, Agent, or Firm* — McGarry Bair Pc

(57) ABSTRACT

A liquid cooling circuit includes a liquid reservoir for coolant, a heat-generating module, a conduit fluidly coupling the heat-generating module with the liquid reservoir, and a pump configured to move the coolant through the conduit to cool the heat-generating module. The liquid cooling circuit is configured such that the movement of the coolant relative to the heat-generating module transfers heat from the heat-generating module to the coolant.

20 Claims, 5 Drawing Sheets

(56) References Cited

U.S. PATENT DOCUMENTS

| | | | | |
|---|---|---|---|---|
| 4,475,340 | A * | 10/1984 | Tseng | F02B 35/02 123/557 |
| 7,458,365 | B2 * | 12/2008 | Hazama | F04B 49/065 123/509 |
| 10,135,081 | B2 * | 11/2018 | Riordan | H01M 8/04014 |
| 2003/0148679 | A1 * | 8/2003 | Matsuda | B63H 11/10 440/88 G |
| 2004/0194910 | A1 * | 10/2004 | Garner | F01P 3/22 165/11.1 |
| 2011/0132320 | A1 * | 6/2011 | Ulrey | F02D 41/005 123/299 |
| 2012/0048242 | A1 * | 3/2012 | Surnilla | F02D 19/022 123/497 |
| 2013/0240066 | A1 * | 9/2013 | Ono | F02M 37/22 137/565.01 |
| 2015/0075754 | A1 * | 3/2015 | Engelhardt | H05K 7/20254 165/104.26 |
| 2016/0252056 | A1 * | 9/2016 | Johnson | F02D 41/3082 123/557 |
| 2017/0152823 | A1 * | 6/2017 | McGrew | F01P 3/16 |
| 2018/0155046 | A1 * | 6/2018 | Bowman | B64D 37/005 |

FOREIGN PATENT DOCUMENTS

| | | | |
|---|---|---|---|
| FR | 3011580 | A1 | 4/2015 |
| JP | 5557636 | A | 4/1980 |
| JP | 09126044 | A | 5/1997 |

* cited by examiner

METHOD AND APPARATUS FOR COOLING A HEAT-GENERATING MODULE

BACKGROUND OF THE INVENTION

Heat-generating modules can include one or more heat-generating components that, if operated without intervention, can fail due to thermal stress. Example heat-generating modules or components can include electricity consuming components or power dissipating components, such as a resistive element, or power converting components, such as a transformer. The heat-generating modules can also be affected by additional operating or environmental factors. Additional factors that can impact the heat-generating modules can include, but are not limited to, the amount of heat generated, the rate of heat generation, the length of time operated, or the operating environment such as ambient temperature, solar load, or volumetric space. Thus, heat-generating modules can be designed to operate under specific heat management or heat-mitigation configurations.

A heat management or heat-mitigation configuration can include passive or active cooling features. Passive cooling systems typically focus on thermal control, or thermal management that uses virtually no additional energy, apart from the energy utilized by the heat-generating module, itself. For example, a first heat-generating module can be configured to expose a surface, or a series of thermally conductive fins thermally coupled with the module, to the ambient air in order to passively dissipate an amount of heat by way of thermal convection or thermal radiation to the surrounding environment. Moreover, the heat-generating module can be heat sunk to a thermal mass that can absorb its heat dissipation by conduction heat transfer and through an internal energy capture of the material. In contrast, active cooling typically utilizes additional energy to effect cooling of the heat-generating module by use of an enthalpy differential. For example, a second heat-generating module can include a fluid (liquid or air) cooling circuit in thermal proximity to the module, and configured to operably dispense a fluid (liquid or air) through the circuit, wherein the fluid absorbs a portion of the heat and carries it away from the module, to actively dissipate an amount generated by the module by way of an increase in the enthalpy of the moving fluid.

Certain heat-generating modules need to be designed to operate in accordance with a wide variety of operating or environmental factors, including desert climate, freezing climate, or, in the examples of active cooling systems, available energy sources.

BRIEF DESCRIPTION OF THE INVENTION

In one aspect, a liquid cooling circuit includes a liquid reservoir for combustible fuel having an autoignition temperature, a heat-generating module, a conduit fluidly coupling the heat-generating module with the liquid reservoir, a pump configured to move the combustible fuel through the conduit to cool the heat-generating module, a temperature component configured to determine the temperature of the combustible fuel, and a controller module configured to control the pumping of the combustible fuel by ceasing the pumping when the temperature of the combustible fuel satisfies a comparison with a predetermined temperature threshold relative to the autoignition temperature.

In another aspect, a cooling circuit includes a combustion engine configured to operate the vehicle, a liquid reservoir for combustible fuel to operate the combustion engine, wherein the combustible fuel has an autoignition temperature, a heat-generating module, a first conduit fluidly coupling the liquid reservoir with the combustion engine, a second conduit fluidly coupling the heat-generating module with the liquid reservoir, a pump configured to move the combustible fuel through the first and second conduits to cool the heat-generating module, a temperature component configured to determine the temperature of the combustible fuel, and a controller module configured to control the pumping of the combustible fuel by ceasing the pumping through the second conduit when the temperature of the combustible fuel satisfies a comparison with a predetermined temperature threshold relative to the autoignition temperature.

In yet another aspect, a method for cooling a heat-generating module includes pumping, by a pump, combustible fuel from a liquid reservoir to the heat-generating module to cool the heat-generating module, wherein the combustible fuel absorbs heat from the heat-generating module, sensing, by a sensor module, a temperature of the combustible fuel, providing the temperature of the combustible fuel to a controller module, determining, in the controller module, whether the temperature of the combustible fuel satisfies a predetermined temperature threshold relative to the autoignition temperature of the combustible fuel, and in response to determining the temperature of the combustible fuel satisfies the predetermined temperature threshold, controlling, by the controller module, the pumping combustible fuel.

DESCRIPTION OF EMBODIMENTS OF THE INVENTION

Embodiments of the invention can be implemented in any environment, apparatus, or method for cooling a heat-generating module regardless of the function performed by the heat-generating module.

Figure 1:
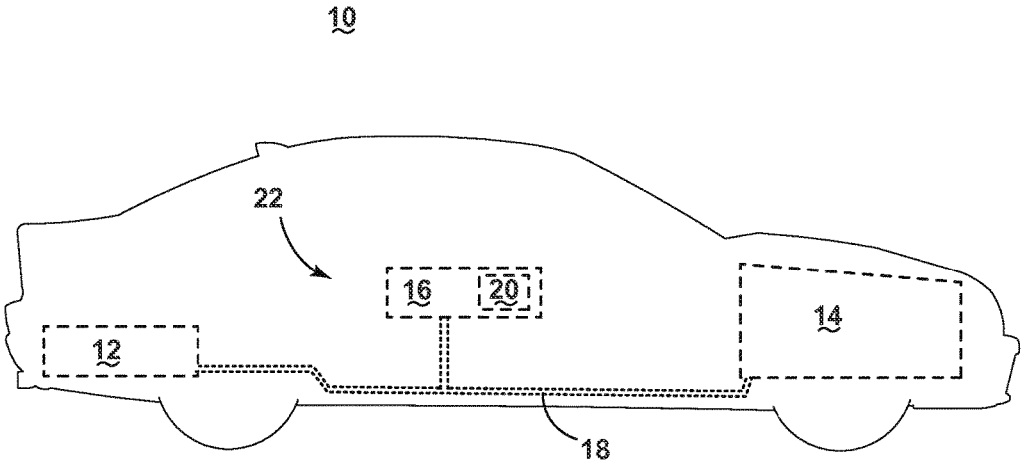
FIG. 1 illustrates an example side view of a vehicle, shown as a car, having a liquid cooling circuit in accordance with various aspects described herein.

FIG. 1 illustrates a vehicle 10, shown as an automobile, having a liquid reservoir 12, an engine 14, and a heat-generating module 16. As shown, the liquid reservoir 12, engine 14, and heat-generating module 16 can be fluidly coupled by a set of conduits 18 such as piping, hoses, or the like. The liquid reservoir 12 can be permanently affixed or selectively coupled with the vehicle 10 and can include virtually any sealed or unsealed fluid container configured to save, store, or otherwise provide a fluid, such as a combustible fuel, to the vehicle 10. Exemplary liquid reservoirs 12 can include, but are not limited to, a tank, a barrel, a can, a canister, jug, drum, or the like. Additionally, combustible fuel can include, but is not limited to, gasoline having various octane ratings, kerosene, diesel fuel, or any other combustible fuel.

While this description is primarily directed toward a liquid reservoir 12 in the form of a fixed automobile gasoline tank (shown in FIG. 2), it is also applicable to virtually any combination, set, or subset of the aforementioned reservoirs 12. Furthermore, embodiments of the disclosure can include a reservoir 12 configured to save, store, contain, or otherwise provide a gaseous combustible fuel, or gaseous/liquid hybrid fuel, such as hydrogen stored as a liquid and combusted as a gas. Moreover, while the vehicle 10 illustrated is in the form of a car, embodiments of the disclosure are not so limited. Non-limiting examples of embodiments of the disclosure can include vehicles 10 wherein the combustion engine is configured to operate in at least one of a land-based vehicle (e.g. cars, trucks, industrial or commercial vehicles, mining equipment, and the like), air-based vehicle, or water-based vehicle.

The engine 14 can include an internal combustion engine configured to operate the vehicle 10 by way of combusting the combustible fuel, for example, supplied via the conduit 18. In this example, "operating the vehicle" 10 can include, but is not limited to, providing propulsive force for vehicle 10 movement or providing electrical power for the vehicle 10 or heat-generating module 16. Alternatively, "operating the vehicle" 10 can also include providing available force, power, or the like, regardless of if the provided force, power, or the like is utilized (e.g. idling the engine 14).

The heat-generating module 16 can include a device that produces, provides, or supplies a net amount of heat during operation. Example heat-generating modules 16 can include, but are not limited to, electricity consuming or producing components such as a resistive element or generator, power converting components such as a transformer, a diode, a voltage regulator, etc., or the like. Alternatively, the heat-generating module 16 can include, but is not limited to, a machine, device, or apparatus that generates heat by way of mechanical or chemical operations, such as combustion, friction, or the like. For example, embodiments of the disclosure are envisioned wherein the engine 14 is also a heat-generating module 16. Embodiments of the disclosure are envisioned wherein the heat-generating module 16 provides a function for the vehicle 10 itself, or wherein the heat-generating module 16 provides a function for non-vehicle 10, or off-vehicle 10 functionalities. Stated another way, while the heat-generating module 16 is shown schematically as a part of the vehicle 10, the functionality of the module 16 can be directed to the vehicle 10 or system besides the vehicle 10. Embodiments of the disclosure are further envisioned wherein the heat-generating module 16 is controllable independent from the vehicle 10, or remotely from another location away from the vehicle 10.

The heat-generating module 16 can further include one or more of the aforementioned components, or can include a packaged configuration of a set of components, such as a light, a laser, a printed circuit board, or a power converter. Moreover, the heat-generating module 16 can include mounting or packaging components for selectively or fixedly securing the components relative to the module 16 or vehicle 10.

The heat-generating module 16 can further include a thermal interface 20 for thermally coupling at least a portion of the heat-generating module 16 with a cooling system configured to remove, dissipate, or otherwise remove at least a portion of the heat generated by the module 16. Examples of the thermal interface 20 can include, but are not limited to, configurations including a cooling plate, a set of fluid passageways, a heat exchanger, a set of cooling fins, or the like. Embodiments of the disclosure are envisioned having additional thermal interfaces 20, or a combination of interfaces 20. Moreover, the thermal interface 20 can be formed, assembled, or manufactured out of any thermally conductive material configured to transfer an amount of heat away from the heat-generating module 16 by way of the thermal interface 20.

The heat-generating module 16 can also be configured such that at least a portion of the modules 16 of the thermal interface 20 is fluidly coupled with the liquid reservoir 12, for example, by way of the conduit 18. In this sense, the heat-generating module 16 or thermal interface 20 can be configured to operably receive a supply of combustible fuel from the liquid reservoir 12 such that the combustible fuel can be utilized to cool heat generated by the heat-generating module 16. Collectively, at least a portion of the liquid reservoir 12, the heat-generating module 16, the thermal interface 20, or the conduit 18 define a liquid cooling circuit 22 configured to cool the heat-generating module 16. For example, a heat-generating module 16 having a thermal interface 20 in the form of a cold plate can be configured to include cold plate passageways. In this example, the passageways can receive the combustible fuel, cooling the cold plate (not shown), which in turn allows the cold plate to remove heat from the heat-generating module 16.

While the vehicle 10 is schematically shown to include the aforementioned components, additional components can be included. For example, the vehicle 10 can also include a battery or power-generating system to power or operate the engine 14, heat-generating module 16, or additional vehicle subsystems. Alternatively, the engine 14 can be configured with a generator to provide electrical power for operating any of the aforementioned components.

Figure 2:
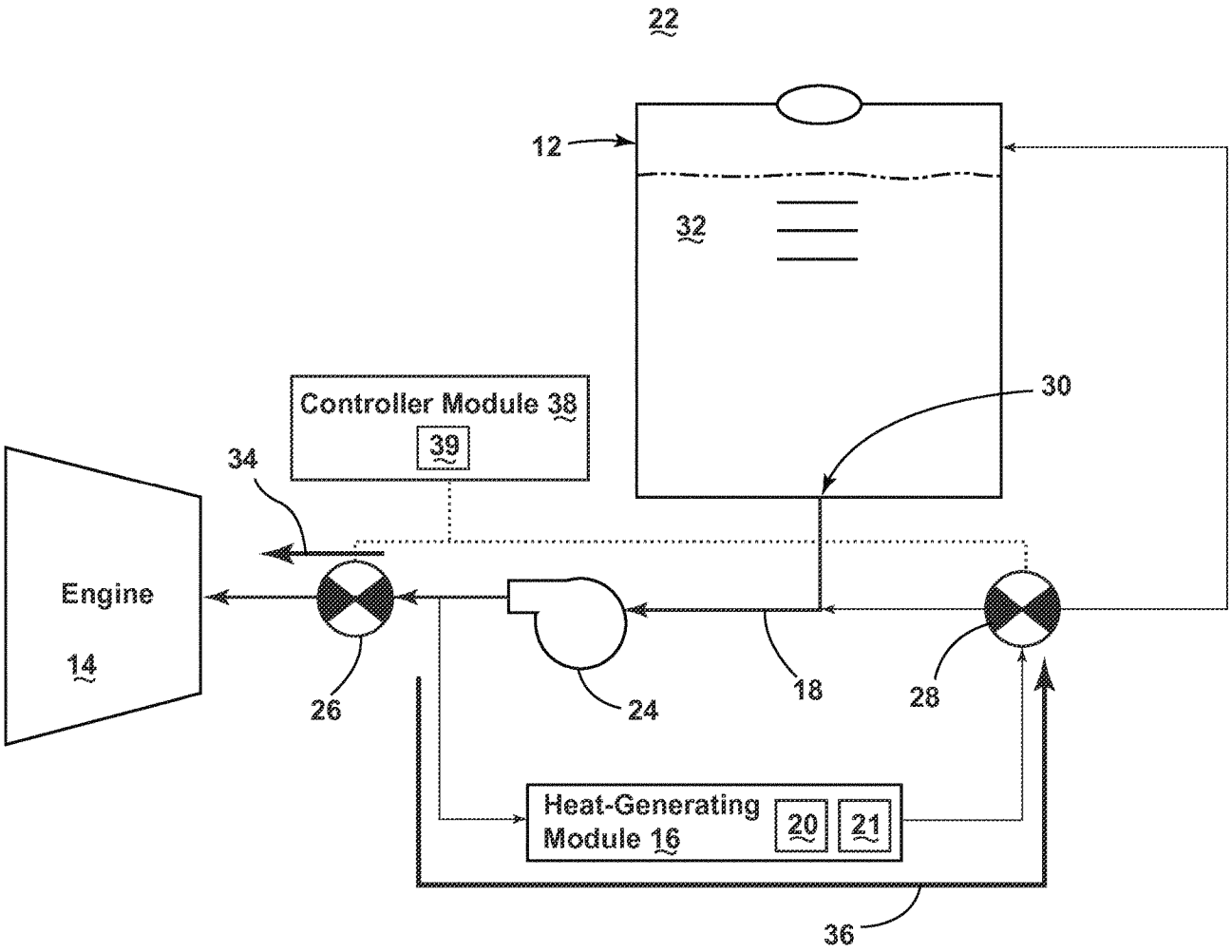
FIG. 2 illustrates an example schematic view of a liquid cooling circuit in accordance with various aspects described herein.

FIG. 2 illustrates a schematic view of the liquid cooling circuit 22 and engine 14 of FIG. 1. As shown, the liquid cooling circuit 22 can include a liquid pump 24 fluidly coupled with the fluid reservoir 12 by way of the conduit 18, and a set of valves, shown as a first valve 26 and a second valve 28. The fluid reservoir 12 includes a fluid outlet 30 for allowing combustible fuel 32 to flow into the conduit 18. The pump 24 can be positioned fluidly downstream of the fluid outlet 30 and configured to forcibly pump, move, or otherwise flow the combustible fuel 32 in the conduit downstream at a controllable rate. The pump 24 can include, but is not limited to, an electric or mechanically-operated pump. Non-limiting examples include a pump 24 that can be operated by electricity generated by the engine 14 or another electrical source, by mechanical power delivered by the engine 14 during operation, or by a user-operated hand pump.

The first valve 26 can be positioned fluidly between the pump 24 and the engine 14, to define a first fluid path (shown as arrow 34) to the engine 14. Combustible fuel 32 that traverses the conduit 18 along the first fluid path 34 can be utilized for operating the combustion engine 14, as described above. A second fluid path (show as arrow 36) can include a portion of the conduit 18 downstream from the pump 24, and flows through or otherwise interacts with the heat-generating module 16 or thermal interface 20, and into the second valve 28. As illustrated, the heat-generating module 16 can further include a temperature sensor 21 or temperature sensing component configured to generate a heating module temperature signal indicative of the sensed, measured, expected, estimated, or desired temperature of the heat-generating module 16 or thermal interface 20. The second valve 28 is further configured to selectably allow combustible fuel 32 traversing the second fluid path 36 to, for example, return to the liquid reservoir 12, or recirculate via the conduit 18 to the first fluid path 34, second fluid path 36, or another destination. While the temperature sensor 21 is described as a subcomponent of the heat-generating module 16, embodiments of the disclosure are envisioned where one or more temperature sensors 21 can be located in additional or alternative locations. Non-limited examples can further include one or more temperature sensors 21 located downstream of the heat-generating module 16, or within the liquid reservoir 12.

The liquid cooling circuit 22 can further include a controller module 38 in bi-directional communication with at least one of the pump 24, temperature sensor 21, first valve 26, or second valve 28, and configured to operate the respective pump 24, first valve 26, or second valve 28. The controller module 38 can include, in one non-limiting example, a controller and a computer program having an executable instruction set for operating a set or subset of the communicatively coupled components, as described above. The controller module 38 can further include any suitable type of controller including a Proportional Integral Differential (PID) controller or an on/off controller.

For context, a PID can include a control loop feedback mechanism 39 that calculates an error signal as the difference between a desired set point and a measured process variable. For example, the control loop feedback mechanism 39 can receive a signal indicative of a fluid flow rate through the first or second valve 26, 28, a signal indicative of a fluid pumping rate from the pump 24, or a heating module temperature signal from the heat-generating module 16 or thermal interface 20, or combination thereof. Collectively, the set or a subset of the signals received by the control loop feedback mechanism 39 is referred to as operational data. The control loop feedback mechanism 39 can, in turn, execute the computer program for operating the set or subset of the communicatively coupled components, in response to the operational data received by the control loop feedback mechanism 39.

A PID or control loop feedback mechanism 39 can attempt to minimize the error signal by adjusting the process control inputs; that is, the fluid flow rate through the first or second valve 26, 28 by opening or closing the respective valves 26, 28, or the fluid pumping rate of the pump 24, or combination thereof. As is well-known in controls applications, the PID controller calculation for minimizing the error involves three separate constant parameters: the proportional, the integral and derivative values. The proportional, the integral and derivative values characterize the present error, the accumulation of past errors and the prediction of future errors. The weighted sum of these attributes is used to adjust the process control inputs described above, and better match the needs of the liquid cooling circuit 22 or heat-generating module 16. Other control schemes may use a subset of these control attributes (and form one of a PI, PD, P or I controller).

The computer program can include a computer program product that can include machine-readable media for carrying or having machine-executable instructions or data structures stored thereon. Such machine-readable media can be any available media, which can be accessed by a general purpose or special purpose computer or other machine with a controller. Generally, such a computer program can include routines, programs, objects, components, data structures, and the like, that have the technical effect of performing particular tasks or implement particular abstract data types. Machine-executable instructions, associated data structures, and programs represent examples of program code for executing the exchange of information as disclosed herein. Machine-executable instructions can include, for example, instructions and data, which cause a general purpose computer, special purpose computer, or special purpose processing machine to perform a certain function or group of functions. Embodiments of the disclosure are envisioned wherein the controller module 38 can additionally receive the operational data from a controllable component, the control loop feedback mechanism 39, or from an external signal generated by, for example, the vehicle 10, the heat-generating module 16, or a user operating the vehicle 10 or module 16.

The operational data can further include, but is not limited to, data regarding operation of the engine 14, or user input (e.g., a user depressing an acceleration pedal in a vehicle 10). For example, the controller module 38 can be configured to operate (e.g., open) the first valve 26 to allow combustible fuel 32 access to the engine 14, and operate the pump 24 to forcibly deliver the fuel 32 to the engine 14 by way of the first fluid path 34 based on the operational data or control loop feedback mechanism 39 operation. In this example, the pump 24 can be further controllable by the controller module 38 or control loop feedback mechanism 39 to deliver combustible fuel 32 at a delivery rate related with (e.g. proportional to), or throttled according to, the desired acceleration.

The controller module 38 or control loop feedback mechanism 39 can process, compare, or otherwise interpret the heating module temperature signal of the temperature sensor 21 and determine cooling is necessary for the heat-generating module 16 based on the temperature signal. For instance, the controller module 38 or control loop feedback mechanism 39 can either open or close the first valve (depending on whether the engine 14 is operating), operate the pump 24 to forcibly deliver combustible fuel 32 to the heat-generating module 16 or thermal interface 20 by way of the second fluid path 34.

The controller module 38 or control loop feedback mechanism 39 can operate the pump 24 based at least in part on a desired operational temperature threshold value or desired operational temperature range of the heat-generating module 16 or thermal interface 20. The desired operational temperature threshold value or desired operational temperature range of the heat-generating module 16 or thermal interface 20 can include, but is not limited to, a predetermined temperature value or temperature range, or a relative temperature value or temperature range related to the ambient temperature (e.g. 50% greater than the ambient temperature) or the temperature of the combustible fuel (e.g. 50% greater than the temperature of the combustible fuel or 10% below an autoignition temperature of the combustible fuel, as further explained below). While examples of the predetermined temperature value, temperature range, or relative temperatures are described as percentages (i.e. 50% greater than), embodiments of the disclosure are envisioned wherein the value or ranges are expressed in degrees (e.g. 50 degrees Celsius greater than the ambient temperature, etc.).

In one embodiment of the disclosure, the temperature threshold value or temperature range can be a predetermined value or range based on the combustible fuel 32 utilized, and stored in memory of the controller module 38. In one controlling example, the pump 24 can be controlled by the controller module 38 to deliver additional combustible fuel, and thus, increased cooling capability, during instances of high heat generation (e.g. during periods of heat generation at or greater than 75% of a maximum heat generation or overall thermal load of the heat-generating module 16). The controller module 38 can be further configured to operate the second valve 28 to either return the fuel 32 to the liquid reservoir 12, or recirculate via the conduit 18 to the first fluid path 34, second fluid path 36, or another destination. In yet another controlling example, the controller module 38 can controllably operate the heat-generating module 16 to cease heat-generating operations altogether.

The controlling by the control module 38 can include controlling the various components in response to determining whether the temperature of the combustible fuel 32, as sensed or measured by the temperature sensor 21, satisfies a comparison with the temperature threshold value or range. For example, when the sensed temperature of the combustible fuel 32 reaches or exceeds the threshold temperature value, the controller module 38 can control or operate the liquid cooling circuit 22, as explained above, to ensure the combustible fuel 32 does not reach the autoignition temperature of the fuel 32 and combust. In another example, when the sensed temperature of the combustible fuel 32 reaches or is within the threshold temperature range, the controller module 38 can control or operate the liquid cooling circuit 22, as explained above, to ensure the combustible fuel 32 does not exceed the threshold temperature range, or even operates the circuit 22 to maintain the temperature of the fuel 32 to stay within the threshold value range. The term "satisfies" the threshold value or range is used herein to mean that the combustible fuel 32 temperature satisfies the predetermined threshold, such as being equal to or less than the threshold value, or being within the threshold value range. It will be understood that such a determination may easily be altered to be satisfied by a positive/negative comparison or a true/false comparison.

Figure 3:
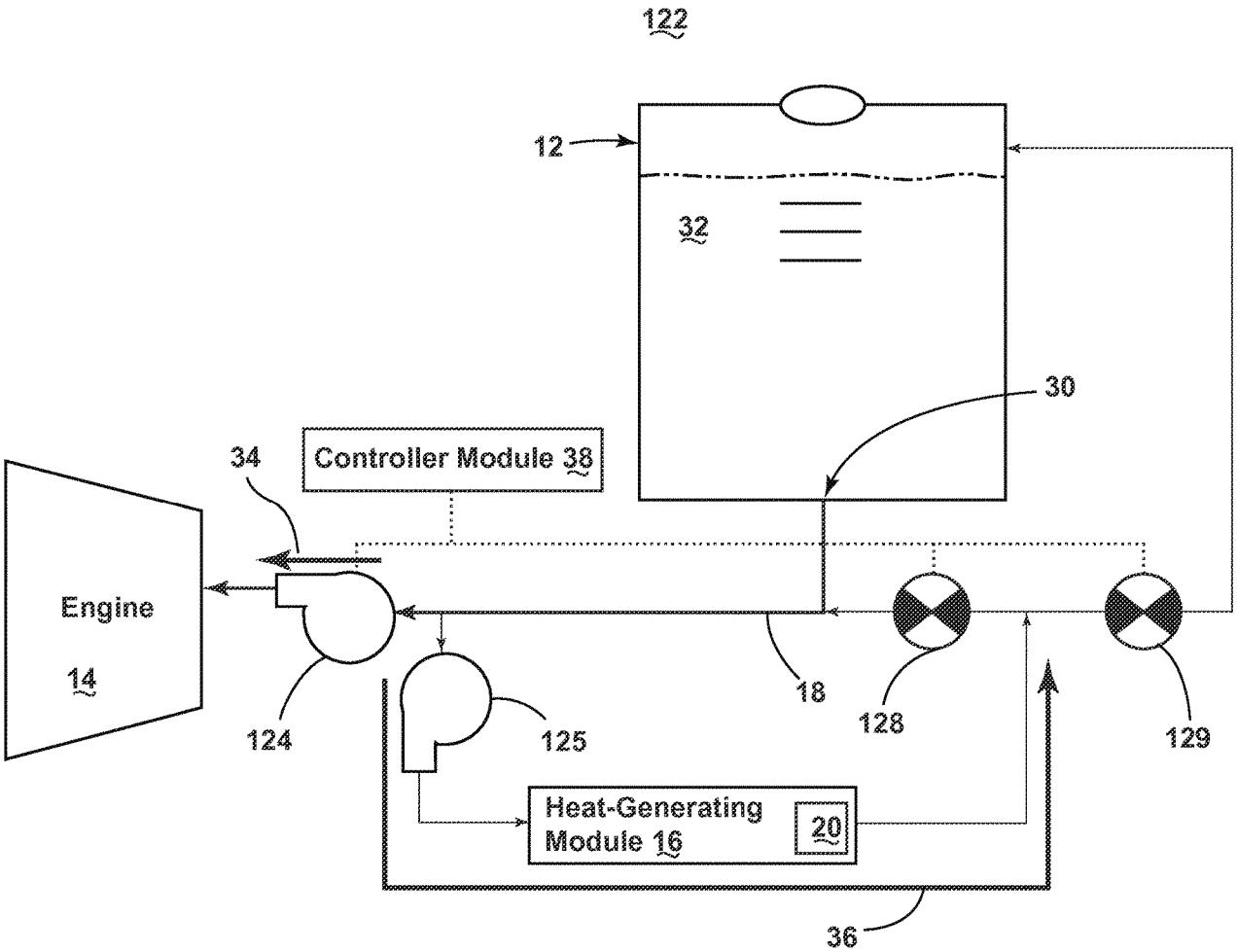
FIG. 3 illustrates an example schematic view of a liquid cooling circuit in accordance with various aspects described herein.

FIG. 3 illustrates an alternative liquid cooling circuit 122 according to a second embodiment of the invention. The second embodiment is similar to the first embodiment; therefore, like parts will be identified with like numerals increased by 100, with it being understood that the description of the like parts of the first embodiment applies to the second embodiment, unless otherwise noted. A difference between the first embodiment and the second embodiment is that the one pump 24 of the first embodiment has been replaced by a corresponding first pump 124 in line with or dedicated to the first fluid path 34 and a second pump 125 in line with or dedicated to the second fluid path 36. The controller module 38 can be communicatively coupled with the first pump 124 and second pump 125, and independently operate the pumps 124, 125, as described herein.

Another difference between the first embodiment and the second embodiment is that the second valve 28 has been replaced by a corresponding second valve 128 controlling access to return combustible fuel 32 to the conduit 18 and a third valve 129 controlling access to return fuel 32 to the liquid reservoir. The controller module 38 can be communicatively coupled with the second valve 128 and third valve 129 to independently operate the valves 128, 129, described herein.

Figure 4:
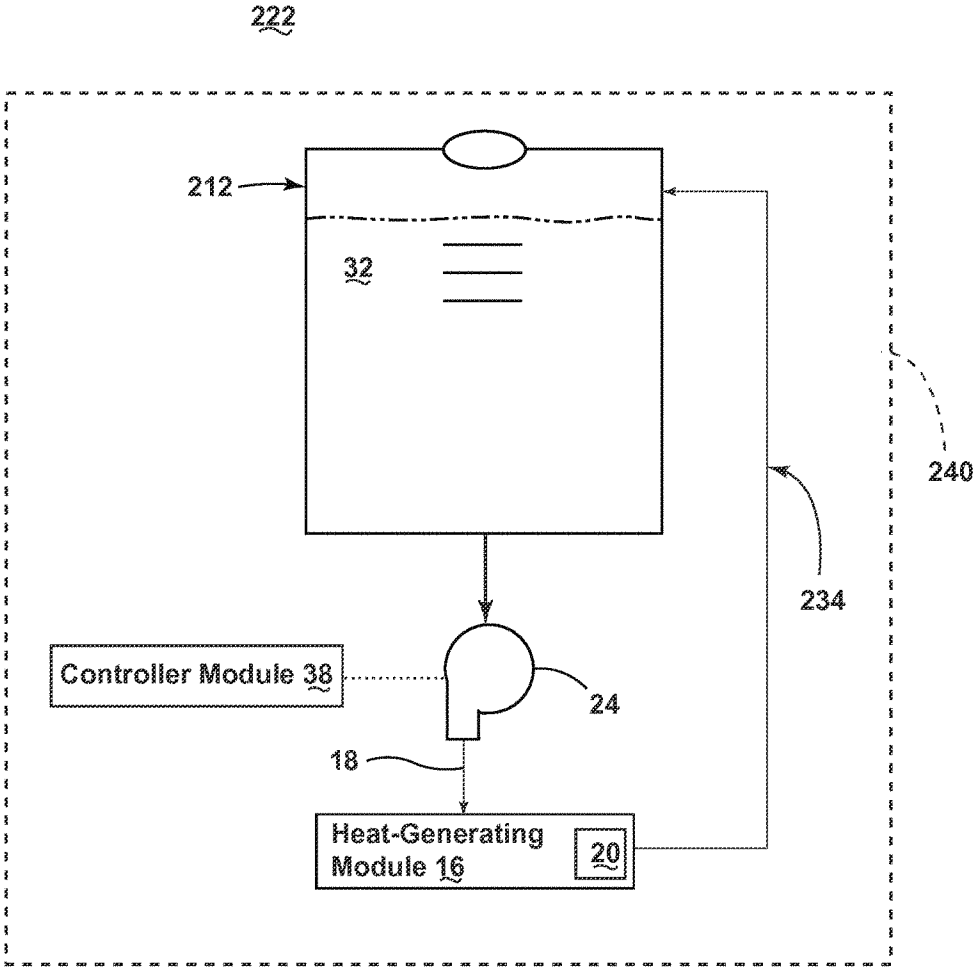
FIG. 4 illustrates an example schematic view of a liquid cooling circuit in accordance with various aspects described herein.

FIG. 4 illustrates an alternative liquid cooling circuit 222 according to a third embodiment of the invention. The third embodiment is similar to the other embodiments; therefore, like parts will be identified with like numerals increased by 200, with it being understood that the description of the like parts of the other embodiment applies to the third embodiment, unless otherwise noted. The third embodiment differs from the other embodiments in that only a single fluid path 234 exists defined by conduits 18 from the liquid reservoir 212, through the pump 24, cooling the heat generating module 16 or thermal interface 20, and returning to the reservoir 12. The liquid cooling circuit 222 of the third embodiment can further be configured to operate independently from the vehicle 10, be removed from the vehicle 10 for mobility or accessibility, or exist without the need of a vehicle 10. In this embodiment, the liquid cooling circuit 222 can include a liquid reservoir 212 in the form of a gas can or barrel (for example, smaller than a liquid reservoir 12 of a vehicle 10), and be completely contained in a mobile module 240, such as a handheld unit. Many configurations of mobile modules 240 are envisioned by embodiments of the disclosure, and can be configured to suit the needs of particular liquid cooling circuit 222 operations, such as mobility, accessibility, available mechanical or electrical power supplies, etc.

While a controller module 38 is illustrated communicatively coupled with the pump 24, the third embodiment can include, but is not limited to, a hand-driven mechanical pump, if electrical or other mechanical power supplies are limited. Additionally, embodiments of the disclosure are envisioned wherein the heat-generating module 16 or thermal interface 20 are located remote from the mobile module 240, and the mobile module 240 is configured to include respective fluid coupling ports to fluidly couple with the external heat-generating module 16 or thermal interface 20.

Figure 5:
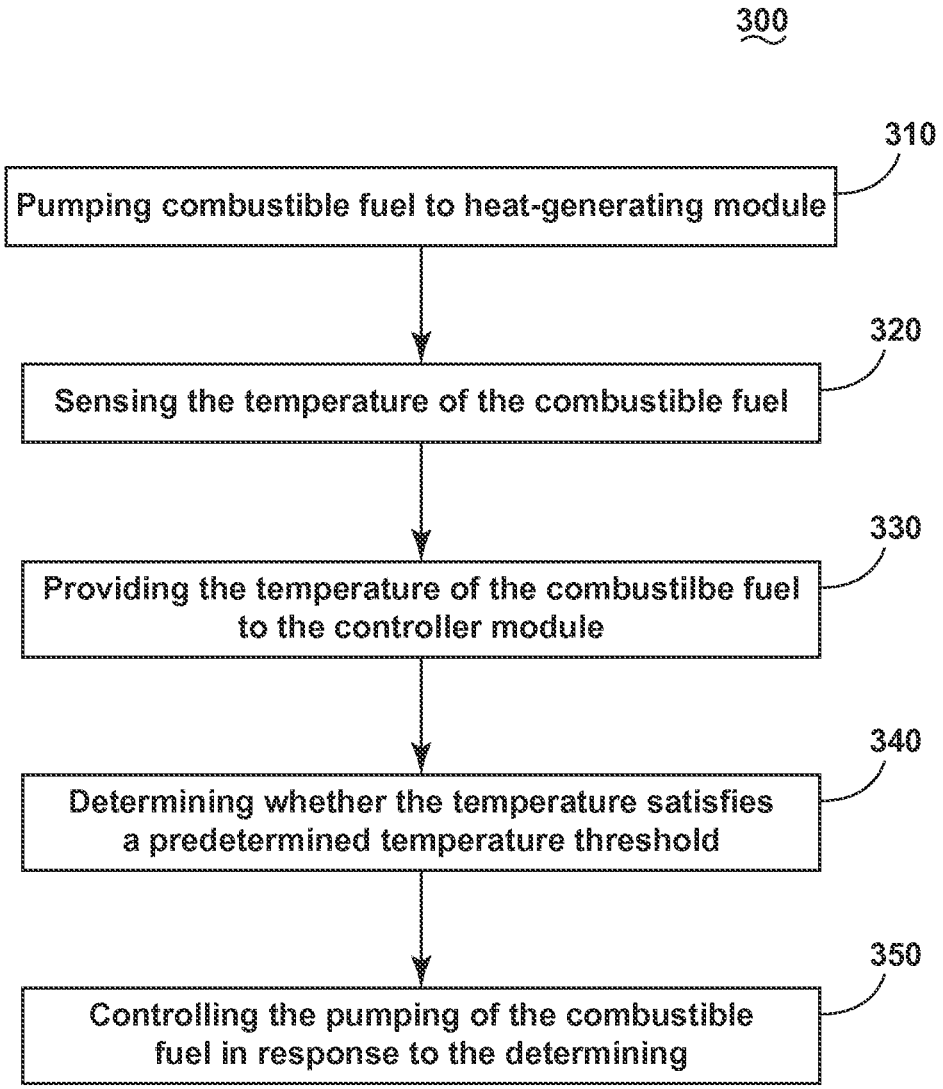
FIG. 5 is an example a flow chart diagram of demonstrating a method of for cooling a heat-generating module in accordance with various aspects described herein.

FIG. 5 illustrates a flow chart demonstrating a method 300 of cooling a heat-generating module 16. The method 300 begins by pumping 310, by at least one of the pumps 24, 124, 125, the combustible fuel 32 from the liquid reservoir 12 to the heat-generating module 16 to cool the heat-generating module 16. The cooling occurs when the combustible fuel 32 absorbs the heat from the heat-generating module 16. Next, the method 300 includes sensing 320, by a sensor module such as the temperature sensor 21, the temperature of the combustible fuel 32. As explained herein, the sensing can take place in-line of the liquid cooling circuit 22, at the heat-generating module 16, in the liquid reservoir 12, etc. The sensed temperature of the combustible fuel 32 can then be provided 330 to the controller module 38.

The controller module 38, in turn, determines 340 whether the temperature of the combustible fuel 32 satisfies a predetermined temperature threshold relative to the autoignition temperature of the combustible fuel 32. Finally, in response to determining 340 that the temperature of the combustible fuel 32 satisfies the predetermined temperature threshold, controlling 350 by the controller module 38 the pumping of the combustible fuel 32, as explained herein. As explained above, the controlling 350 the pumping of the combustible fuel 32 can include maintaining the temperature of the combustible fuel 32 within a predetermined temperature threshold range, or can further include pumping the combustible fuel 32 from the heat-generating module 16 to the engine 14 for combustion. In yet another example embodiment of the disclosure, the method 300 can further include controlling the pumping of combustible field 32 from the heat-generating module 16 to the engine 14 in response to determining 340 the temperature of the combustible fuel 32 satisfies a predetermined temperature threshold range relative to the autoignition temperature of the combustible fuel 32.

The sequence depicted is for illustrative purposes only and is not meant to limit the method 300 in any way as it is understood that the portions of the method can proceed in a different logical order, additional or intervening portions can be included, or described portions of the method can be divided into multiple portions, or described portions of the method can be omitted without detracting from the described method.

Many other possible embodiments and configurations in addition to that shown in the above figures are contemplated by the present disclosure. For example, one embodiment of the invention contemplates a temperature sensing component configured to sense the temperature of the combustible fuel 32, for example, in the liquid reservoir 12 or downstream from the heat-generating module 16 or thermal interface 20. In such an embodiment, the temperature sensing component can be further configured to generate a signal indicating the temperature of the combustible fuel 32 to the controller module 38 or another controlling entity such that at least one of the vehicle 10, engine 14, valves 26, 28, 128, 129, pumps 24, 124, 125, or heat-generating module 16 can be controllably operated based on the temperature of the combustible fuel 32.

Since the fuel 32 is combustible, the controller module 38 or other controlling entity can further ensure the aforementioned components are operated to ensure the temperature of the fuel 32 remains below the autoignition temperature of the fuel 32. In one example, the autoignition temperature of gasoline can be between 245 degrees Celsius and 280 degrees Celsius. The autoignition temperature of the combustible fuel 32 can be determined by way of standardized testing methods, including, but not limited to, ASTM-E659 and MIL-STD-810 testing methods. Alternatively, the controller module 38 or other controlling entity can be configured such that the operation of the aforementioned components ensure the temperature of the fuel 32 remains a predetermined amount below the autoignition temperature of the fuel 32. Non-limiting examples of the predetermined amount below the temperature can include at least ten degrees below the autoignition temperature or ten percent below the autoignition temperature.

Additional configurations or comparisons can ensure autoignition of the combustible fuel 32 does not occur. Additionally, embodiments of the disclosure are envisioned wherein the combustible fuel 32 is configured or selected such that the fuel is non-corrosive, or does not corrode components of the liquid cooling circuit 22, such as the conduits 18, pumps 24, heat-generating module 16 or thermal interface 20. For example, the combustible fuel 32 can include chemical additives to prevent corrosion beyond applicable fuel regulations. Alternatively, corrosion from the combustible fuel 32 can be mitigated, for example, by coating portions of the heat-generating module 16 or thermal interface 20 exposed to the fuel 32 with a coating to prevent corrosion.

Sensing or measuring the temperature of the combustible fuel 32 can include determining a value indicative of or related to the temperature, rather than directly sensing or measuring the temperature itself. The sensed or measured values can be provided to additional components. For instance, the value can be provided to a controller, and the controller can perform processing on the value to determine a temperature of the combustible fuel 32 or an electrical characteristic representative of said temperature. Additionally, the design and placement of the various components such as valves, pumps, or conduits can be rearranged such that a number of different in-line configurations could be realized.

The embodiments disclosed herein provide a liquid cooling circuit for a heat-generating module. The technical effect is that the above described embodiments enable the cooling of said heat-generating module by way of pumping combustible fuel about the heat-generating module as a coolant. One advantage that can be realized in the above embodiments is that the above described embodiments have superior cooling capabilities compared with conventional systems. For example, kerosene and gasoline vary in temperature between −55 degrees Celsius on a cold winter night to 60 degrees Celsius on a hot summer day. Thus, even during expected environmental conditions and diurnal cycles, combustible fuel has a temperature than is typically below a heat-generating component that needs an active cooling system. Furthermore, when combustible fuel absorbs the heat generated, the "hot" fuel can generate improved combustion in the internal combustion engine, thus increasing the thermodynamic cycle efficiency in the engine. By increasing the thermodynamic cycle efficiency in the engine, a vehicle can improve the increase the propulsion of the engine while using less or the same amount of combustible fuel, increasing the fuel range or radius of the vehicle. Stated another way, introducing a higher temperature combustible fuel into the engine reduces fuel consumption, increases the engine performance, and reduces environmentally-harmful mono-nitrogen oxide emissions.

Another advantage that can be realized in the above embodiments is that vehicles typically have a fuel pump incorporated, and a bypass line or conduit is easy to include, limiting the maintenance time and costs of implementing the new cooling system. Moreover, some land-based vehicles are configured to hold up to 500 gallons of combustible fuel in a fuel tank, in addition to supplemental fuel, providing nearly a limitless supply of coolant fluid for the heat-generating module. Additionally, the use of liquid cooling systems to cool heat-generating modules can generally increases the reliability and efficiency of the heat-generating module, whether the module is one or more electronic components such as a power converter or a mechanical component such as an engine or generator.

To the extent not already described, the different features and structures of the various embodiments can be used in combination with each other as desired. That one feature cannot be illustrated in all of the embodiments is not meant to be construed that it cannot be, but is done for brevity of description. Thus, the various features of the different embodiments can be mixed and matched as desired to form new embodiments, whether or not the new embodiments are expressly described. Moreover, while "a set of" various elements have been described, it will be understood that "a set" can include any number of the respective elements, including only one element. Combinations or permutations of features described herein are covered by this disclosure.

This written description uses examples to disclose embodiments of the invention, including the best mode, and also to enable any person skilled in the art to practice embodiments of the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A liquid cooling circuit comprises:

a liquid reservoir for combustible fuel having an autoignition temperature;

a heat-generating module;

a conduit fluidly coupling the heat-generating module with the liquid reservoir;

a pump configured to move the combustible fuel through the conduit to cool the heat-generating module;

a temperature component configured to determine the temperature of the combustible fuel; and a controller module configured to control the pumping of the combustible fuel by ceasing the pumping when the temperature of the combustible fuel satisfies a comparison with a predetermined temperature threshold relative to the autoignition temperature.

2. The liquid cooling circuit of claim 1 wherein the controller module is further configured to maintain the temperature of the combustible fuel within a predetermined temperature threshold range.

3. The liquid cooling circuit of claim 1 further comprising a return conduit downstream from the heat-generating module and fluidly coupling the heat-generating module with the liquid reservoir.

4. The liquid cooling circuit of claim 3 wherein the temperature component is further configured to determine the temperature of the combustible fuel located downstream from the heat-generating module or within the fuel reservoir.

5. The liquid cooling circuit of claim 1 wherein the combustible fuel includes at least one of gasoline, kerosene, diesel fuel, or a gaseous/liquid hybrid fuel.

6. The liquid cooling circuit of claim 1 wherein the liquid cooling circuit is configured to keep the temperature of the combustible fuel at least 10 degrees Celsius below the autoignition temperature of the combustible fuel.

7. The liquid cooling circuit of claim 1 wherein the heat-generating module includes a heat exchanger thermally coupled with the heat-generating module.

8. The liquid cooling circuit of claim 7 wherein the heat exchanger is a cold plate and defines fluid passages configured to operably move the combustible fuel through the cold plate.

9. The liquid cooling circuit of claim 7 wherein the combustible fuel is configured such that it non-corrosively interacts with at least one of the conduit, heat-generating module, or heat exchanger.

10. The liquid cooling circuit of claim 1 wherein the pump is a hand pump.

11. A cooling circuit, comprising:

a combustion engine configured to operate a vehicle;

a liquid reservoir for combustible fuel to operate the combustion engine, wherein the combustible fuel has an autoignition temperature;

a heat-generating module;

a first conduit fluidly coupling the liquid reservoir with the combustion engine;

a second conduit fluidly coupling the heat-generating module with the liquid reservoir;

a pump configured to move the combustible fuel through the first and second conduits to cool the heat-generating module;

a temperature component configured to determine the temperature of the combustible fuel; and a controller module configured to control the pumping of the combustible fuel by ceasing the pumping through the second conduit when the temperature of the combustible fuel satisfies a comparison with a predetermined temperature threshold relative to the autoignition temperature.

12. The cooling circuit of claim 11 wherein the controller module is further configured to maintain the temperature of the combustible fuel within a predetermined temperature threshold range.

13. The cooling circuit of claim 11 further comprising a third conduit downstream from the heat-generating module fluidly coupling the heat-generating module with the first conduit.

14. The cooling circuit of claim 11 wherein the pump is configured to move the combustible fuel through the second conduit regardless of the operational state of the engine.

15. The cooling circuit of claim 11 wherein the temperature component is further configured to determine the temperature of the combustible fuel located downstream from the heat-generating module or within the fuel reservoir.

16. The cooling circuit of claim 11 wherein the combustion engine is configured to operate in at least one of a land-based vehicle, air-based vehicle, or water-based vehicle.

17. A method for cooling a heat-generating module comprising:

pumping, by a pump, combustible fuel from a liquid reservoir to the heat-generating module to cool the heat-generating module, wherein the combustible fuel absorbs heat from the heat-generating module;

sensing, by a sensor module, a temperature of the combustible fuel;

providing the temperature of the combustible fuel to a controller module;

determining, in the controller module, whether the temperature of the combustible fuel satisfies a predetermined temperature threshold relative to the autoignition temperature of the combustible fuel; and in response to determining the temperature of the combustible fuel satisfies the predetermined temperature threshold, controlling, by the controller module, the pumping combustible fuel.

18. The method of claim 17 further comprising controlling the pumping of combustible fuel to maintain the temperature of the combustible fuel within a predetermined temperature threshold range.

19. The method of claim 17, further comprising pumping combustible fuel from the heat-generating module to a combustion engine.

20. The method of claim 19, further comprising controlling the pumping of combustible fuel from the heat-generating module to the combustion engine in response to determining the temperature of the combustible fuel satisfies a predetermined temperature threshold range relative to the autoignition temperature of the combustible fuel.

* * * * *